United States Patent [19]

Fulton et al.

[11] Patent Number: 4,873,134

[45] Date of Patent: Oct. 10, 1989

[54] HOT MELT INK PROJECTION TRANSPARENCY

[75] Inventors: Steven J. Fulton, Hanover, N.H.; Charles W. Spehrley, Jr., Hartford, Vt.; Lawrence R. Young, West Lebanon, N.H.

[73] Assignee: Spectra, Inc., Hanover, N.H.

[21] Appl. No.: 230,797

[22] Filed: Aug. 10, 1988

[51] Int. Cl.[4] ..... B41M 5/00

[52] U.S. Cl. ..... 428/156; 346/135.1; 428/195; 428/207; 428/411.1; 428/480; 428/484; 428/913

[58] Field of Search ..... 428/195, 484, 488.1, 428/913, 914, 207, 480, 156, 411.1; 346/1.1, 135.1

[56] References Cited

U.S. PATENT DOCUMENTS

| | | | |
|---|---|---|---|
| 4,528,242 | 7/1985 | Burwasser | 428/413 |
| 4,547,405 | 10/1985 | Bedell et al. | 428/206 |
| 4,555,437 | 11/1985 | Tanck | 428/212 |
| 4,575,465 | 3/1986 | Viola | 428/200 |
| 4,578,285 | 3/1986 | Viola | 428/483 |
| 4,592,954 | 7/1986 | Malhotra | 428/483 |
| 4,745,420 | 5/1988 | Gerstenmaier | 346/76 |

*Primary Examiner*—Pamela R. Schwartz

*Attorney, Agent, or Firm*—Brumbaugh, Graves, Donohue & Raymond

[57] ABSTRACT

In the particular embodiments of the invention described in the specification, a projection transparency includes a transparent substrate and an ink pattern disposed on one surface of the transparent sheet in the form of three-dimensional ink spots having curved surfaces with a radius of curvature of at least 3 mils and an angle of contact with the substrate of no more than about 25°. The transparency is prepared by applying ink drops to the substrate and maintaining the ink at a temperature above its melting point for a selected time such as 0.5 to 10 seconds. Thereafter, the ink is cooled rapidly to reduce crystallization and frosting and thereby reduce light transmission losses in the ink to less than 50%.

7 Claims, 1 Drawing Sheet

HOT MELT INK PROJECTION TRANSPARENCY

BACKGROUND OF THE INVENTION

This invention relates to projection transparencies made with hot melt ink and to methods for making such transparencies.

Hot melt inks are used in thermal transfer printers and in certain ink jet printers. The characteristic of these inks is that they are solid at room temperature, liquefied by heating for marking, and resolidified by freezing on the marked substrate.

Transparency substrates are made of transparent sheet material, such as a polyester material, which is usually not receptive to liquid materials such as water- and glycol-based inks. When these solvent-based inks are used to make transparencies, the substrate is coated with a layer receptive to the ink and the ink is absorbed into the coating. For example, U.S. Pat. Nos. 4,528,242 to Burwasser, 4,547,405 to Bedell et al., 4,555,437 to Panck, 4,575,465 and 4,578,285 to Viola, and 4,592,954 to Malhotra disclose special coatings which are capable of absorbing inks for transparent base material such as Mylar. Hot melt inks, however, generally can be formulated to wet and adhere to such substrates, but they do not penetrate into the substrate or into a coating on the substrate. Instead, they adhere to the substrate surface and retain a three-dimensional form. In this way they are distinct from inks which are absorbed or dry into a flat spot through evaporation or absorption. Moreover, transparencies differ from fibrous substrates such as described in Japanese Published Application No. 62-135370 in that spreading of the ink will not improve adhesion by absorption.

A colored hot melt ink image created on the surface of a transparent substrate may be composed of individual drops of the ink as supplied in the ink jet drop-generating process, couples of drops, lines of drops or large areas covered completely by drops. Light passing through the surface of the deposited ink is refracted by the local curvature of the ink surface. A first deficiency in color projection occurs when the curvature is large, i.e., the radius of curvature is small, because the light is deflected through a large angle from its original direction and may be lost from the optical path of the projection apparatus. The projected image of this area of the transparency appears dark. If the radius of curvature of the surface is large, light which passes through the substrate and the ink is refacted only slightly and is collected by the projection lens. Hence it is advantageous if the local radius of curvature of the surface of the ink image is sufficiently large over the entire surface of the image. For individual drops of specified volume, the large radius of curvature corresponds to a small contact angle between the ink surface and the transparency substrate. It has been found to be most difficult to render transparent via geometry individual, nonagglomerating spots, lines being somewhat easier and solid area coverage being the easiest. The reason is that single droplets have the greatest ratio of edges to surface area and these edges have the steepest surface angles. Hence, most of the discussion hereinafter will be in the context of individual spots of ink.

In the case of black-and-white transparencies, the major concern is that the deposited ink be able to block or reduce transmission of light through the transparency. However, for this projection of color images, it is necessary for the ink to absorb selected wavelengths and pass significant fractions of the remaining wavelengths in order to produce an image with the correct colors.

When projected from a transparency, the deposited hot melt three-dimensional colored ink spots tend to project gray or black images because of any of three loss mechanisms, i.e., refractive scattering of transmitted light by the droplet in the manner of a dioptric lenticule, surface losses resulting from microroughness (frosting) on the order of one micron, and bulk losses resulting from the formation of crystals within the droplet which have a different index of refraction than the other material in the droplet. The small lenticules formed by the three-dimensional ink spots refract light which passes through them away from path to the projection lens so that they cast gray shadows in projection irrespective of the color of the ink which forms the lenticule.

For naturally amorphous (noncrystalline) materials, the microroughness (frosting) and bulk losses are small, i.e., the spots are glassy and "clear". Unfortunately, as is known in the art, the organic materials which are amorphous and which may be fluid enough to jet at temperatures of 100° C. to 160° C. tend to be very soft at room temperature. Consequently, the durability of the ink on a transparency may be inadequate. Generally, inks which have adequate hardness and which are jettable at temperatures of 100° C. to 160° C. are usually crystalline to a significant extent. Such high crystallinity produces light transmission losses and causes "opacity" of the ink drop. The bulk losses and surface roughness, i.e., frosting, are also a result of the ordered arrangement of the molecules into a plurality of randomly or obilquely oriented or disoriented crystals. hence crystalline inks tend to have a high degree of surface and bulk scattering, producing light transmission losses greater than 50%, so as to project "gray" spots rather than spots with high color purity. On the other hand, such inks are generally suitable for black-and-white transparencies.

Attempts have been made to overcome such problems by pressing the three-dimensional ink spots on the transparent substrate to flatten them as described, for example, in U.S. Pat. No. 4,745,420, but the flattening affects only the uppermost central portions of the spots, leaving the peripheral portions of the ink spots curved so as to refract most of the light passing through the spots away from the path to the projection lens. Some improvement may be gained by heating the image when pressing it in order to reduce the modulus and yield strength of the ink. Nevertheless, although pressing the three-dimensional ink spots in a transparency to flatten them may produce a slight improvement, the images made in this manner are still unsatisfactory.

SUMMARY OF THE INVENTION

Accordingly, it is an object of the present invention to provide a new and improved form of colored hot melt ink projection transparency in which the above-mentioned disadvantages are overcome.

Another objection of the invention is to provide a new and improved method for preparing colored hot melt ink projection transparencies which produces transparencies having improved characteristics.

These and other objects of the invention are attained by providing a transparent substrate, forming an ink pattern on the surface of the substrate which includes three-dimensional ink spots of ink having a curved surface, maintaining the ink pattern at a temperature above the melting point of the ink long enough to cause the ink to flow on the surface of the substrate, thereby providing a substantially increased radius of curvature of the curved surface and a smaller angle of contact with the substrate, and cooling the ink pattern to solidify the ink. If the ink tends to crystallize or produce a frosted surface, the ink is quenched, i.e., cooled at a rapid rate, such as at least 50° C. per second and preferably at least 100° C. per second, to inhibit crystallization and frosting of the ink drops. The resulting transparency according to the invention comprises a transparent substrate and a pattern of three-dimensional ink spots having a curved surface with a large radius of curvature and a small contact angle with the surface of the substrate and having reduced scattering and absorption due to crystallization and frosting so that a large proportion of the desired wavelengths of the light passing through the ink spots is received by a projection lens.

Preferably, the contact angle between the edge of the ink spot and the transparent substrate is no more than about 25° and, for ink spots applied at about 300 per inch, the radius of curvature of the ink spots is at least 5 mils. For closer dot spacings using smaller ink dots, such as 600 dots per inch, the minimum radius of curvature may be correspondingly smaller, such as 2.5 mils. In order to obtain the desired increase in radius of curvature of the ink drop surface and reduced angle of contact with the transparent substrate, the ink pattern is maintained above the melting temperature of the ink long enough to produce the required spread in the size of the ink drops, which may be, for example, from 1 to 5 sec. During this time, the radius of curvature of the surface may increase from about 3 or 4 mils, for example, to about 6 to 8 mils or more and the diameter of the ink drops may spread, for example, from about 3 to 4 mils to about 5 to 5.5 mils, depending on the volume of ink in the drop, reducing the contact angle from about 30° or 40° or more to about 15° or 20° or less.

Although the temperature of the ink pattern may be maintained at the necessary level to permit ink drop spreading as soon as the ink drop pattern has been applied to the transparent substrate, for example, by using a heated platen to support the substrate during application of the ink drops, it is also possible, and in many instances desirable, to reheat a solidified ink drop pattern and maintain it at a temperature above its melting point in the manner of the invention at a later stage in the process, such as by reheating a previosuly formed ink pattern which has solidified. In this way, the temperature of the ink and the time during which it is at a given temperature may be controlled in the desired manner without being influenced by possibly varying rates of heat input during formation of the ink patten or by pauses in the printing operation which may be caused by interruptions in data transmission to the printer.

After the desired spreading of the ink drops has been effected, the molten ink drops in the pattern are cooled, preferably at a rapid rate, i.e., quenched, to prevent crystallization and frosting of the ink drops which would degrade the projected image by bulk and surface scattering of the light transmitted by the ink drops. For ink which may crystallize or cause frosting, such cooling should occur at a rate of at least about 50° C. per second, and preferably at least 100° C. per second, through the temperature range from above the melting temperature of the ink to below the melting temperature of the ink.

BRIEF DESCRIPTION OF THE DRAWINGS

Further objects and advantages of the invention will be apparent from a reading of the following description in conjunction with the accompanying drawings in which.

DESCRIPTION OF PREFERRED EMBODIMENTS

In conventional transparency projectors, the transparency-illuminating optics are usually arranged with a reflector and a collecting lens so that light is transmitted through the transparency in approximately parallel rays, producing an image of the light source in the plane of the projection lens. In this way, except for light which has been scattered in other directions during its passage through the transparency and the illuminating system, substantially all of the illuminating light is collected by the projection lens so as to be useful in forming a projected image. if a substantial proportion of the light passing through each ink spot in the transparency pattern is scattered or absorbed, the image projected by the projection lens will be deficient in contrast and color saturation, providing a generally gray, washed-out appearance.

Figure 1:
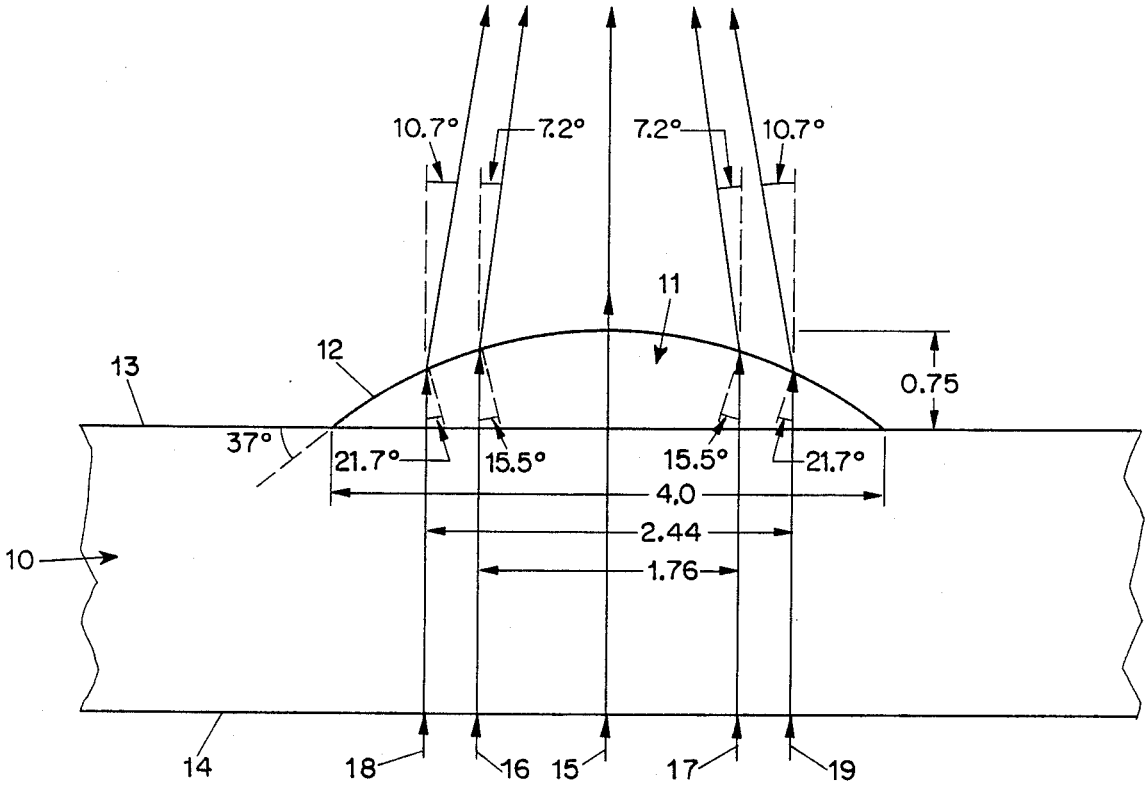
FIG. 1 is a schematic fragmentary sectional view illustrating the transmission of light through a conventional transparency having a three-dimensional ink spot on one surface.

When an ink image is formed on a surface which cannot absorb the ink, such as when hot melt ink is used to make an image on a polyester sheet material, the ink solidifies in the form of three-dimensional spots which have a curved surface similar to the surface of a sphere with a radius of, for example, about 3 to 4 mils and contact angles of about 30° to 40°. A typical ink spot produced in this manner is illustrated in FIG. 1, in which a transparent substrate 10 has a solidified ink spot in the shape of a segment of a sphere. In the illustrated example, the spot 11 has a diameter of about 4 mils, and a maximum thickness of about 0.75 mil, and the radius of its upper surface 12 is about 3.3 mils. Consequently, the surface 12 intersects the upper surface 13 of the substrate 10 at the periphery of the spot 11 at an angle of about 37°.

In a projection system of the type mentioned above, the transparency is illuminated from the opposite side 14 by substantially parallel rays of light 15–19, which , in the example shown in FIG. 1, are incident in a direction approximately perpendicular to the surfaces 13 and 14 of the sheet 10. Essentially perpendicular incidence of the light rays will occur in the central region of the transparency, and at the periphery of the transparency the direction of illuminating light rays may deviate by a relatively small angle from the perpendicular, up to about 15°, for example, depending upon the size of the transparency to be projected and the focal length of the projection lens. Consequently, while the quantitative effects described herein with reference to the illustration in FIG. 1 are applicable to ink spots in the central portion of a transparency being projected, the specific numerical values will differ somewhat for ink spots in the peripheral portions, but the same qualitative effects are applicable with respect to the ink spots in those portions of the transparency. In addition, it will be understood that the shape of each ink spot may deviate somewhat from the typical three-dimensional ink spot shape shown in FIG. 1.

Conventional hot melt inks of the type used in ink jet printing or thermal transfer of images have an index of refraction generally in the range of about 1.40 to 1.60. For purposes of the illustration, the three-dimensional ink spot 11 illustrated in FIG. 1 is assumed to have an index of refraction of 1.45. With that index of refraction, rays entering the spot 11 at a distance of about 44% of the radius of the spot outwardly from the central ray 15, such as rays 16 and 17 shown in FIG. 1, will be incident on the surface 12 at an angle of about 15.5° from the perpendicular, and, upon passage through the surface 12, will be deviated by refraction toward the central ray 15 by an angle of 7.2°. The extent of such deviation from the direction of incidence of the rays increases as the distance from the central ray increases, and rays entering at a distance from the central ray 15 which is 61% of the radius of the ink spot, such as rays 18 and 19, will be incident on the surface 12 and angles of about 21.7° from the perpendicular, resulting in a deviation of those rays by 10.7 ° toward the central ray 15 upon passage through the surface 12.

If the projection lens used in the transparency projection system has an aperture of f/4, which is about the maximum aperture normally used in such systems, the projection lens will subtend an angle of about 14.4° from each point in the image being projected. Thus, if any ray directed toward the projection lens is deviated by more than 7.2° from the line extending between the center of the projection lens and the point being imaged, it will not be collected by the projection lens and will not be useful in forming an image. Consequently, with ink spots in a transparency of the type shown in FIG. 1, only those rays incident on the spot at distances from the center which are less than 44% of the radius of the spot will be transmitted to the projection lens. Such rays comprise only 19.4% of all of the rays incident on the ink spot, resulting in a loss of more than 80% of the incident light.

Even if the aperture of the projection lens is enlarged by 50%, the problem resulting from refraction of rays by ink spots cannot be avoided. In that case, the projection lens would subtend an angle of 21.4° from each spot and would receive rays entering at distances from the central ray 15 up to 61% of the radius of the spot, such as rays 18 and 19 illustrated in FIG. 1. In that case, the lens would receive only about 37% of the rays incident on the ink spot. Thus, even with a substantially larger projection lens, more than 60% of the light incident on each spot is lost. On the other hand, light incident on the substrate 10 where there is no ink spot 11 is fully transmitted to the projection lens, so that the resulting projected ink pattern is relatively dark and substantially colorless in contrast to the relatively brighter background in which no three-dimensional ink spots refract the incident light.

Figure 2:
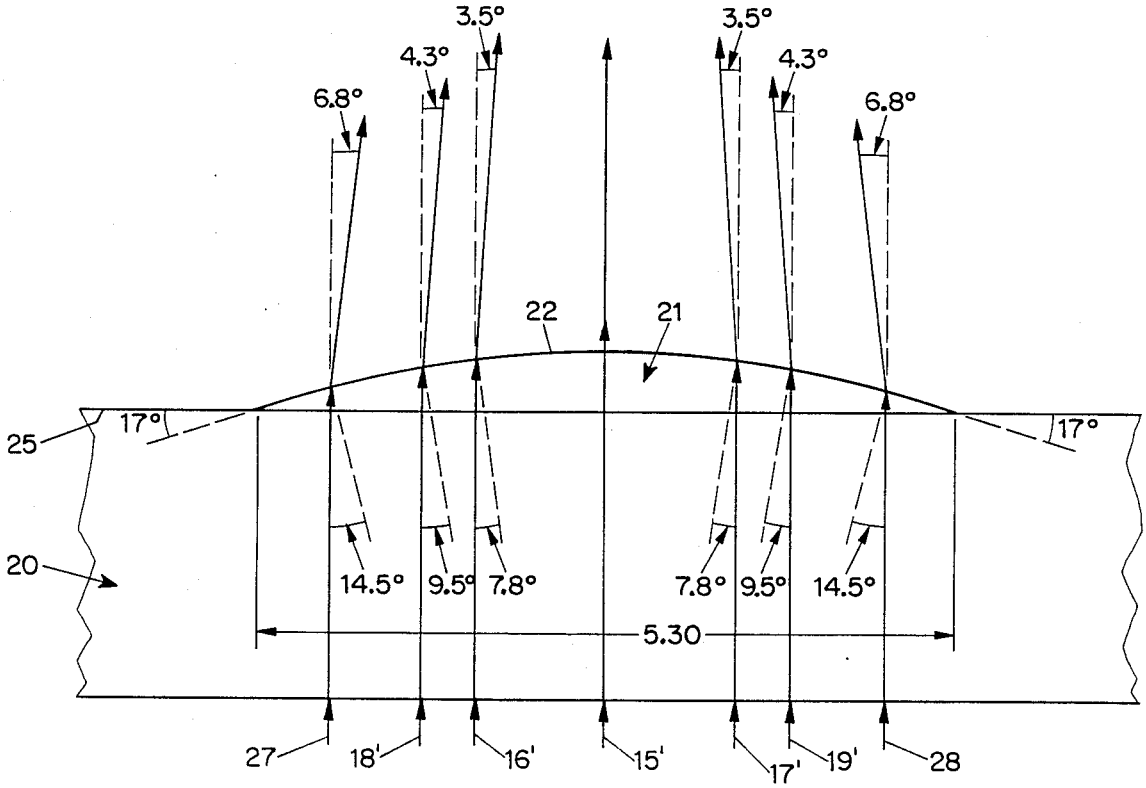
FIG. 2 is a schematic fragmentary sectional view of a transparency prepared in accordance with the present invention, illustrating the transmission of light rays through a three-dimensional ink spot having a curved surface of increased radius of curvature and a reduced angle of contact.

These problems, which have heretofore prohibited the preparation of good-quality projection transparencies using hot melt inks, have been overcome in accordance with the present invention by heating the ink pattern on the transparency above the melting point of the ink long enough to cause the ink drops to spread so that the radius of curvature is increased sufficiently to produce ink drops of large radius of curvature and small angle of contact with the surface of the substrate such as the one illustrated in FIG. 2. As shown in FIG. 2, the transparency includes a transparent substrate 20 having a three-dimensional ink spot 21 with a curved surface 22 having a radius of curvature of about 8 mils, i.e., more than twice that of the spot 11 shown in FIG. 1, and a contact angle of 17°, i.e., less than half the contact angle of th spot shown in FIG. 1. Moreover, the increase in radius of curvature is accompanied by corresponding increase in ink spot diameter from 4.0 mils to 5.3 mils. This provides the advantage of increased surface coverage for spots produced by an ink jet which projects ink drops in a 3.3 mil by 3.3 mil array, as described in the co-pending Spehrley application for "Controlled Ink Drop Spreading in Hot Melt Ink Jet Printing", Ser. No. 202,488 filed June 3, 1988.

In the co-pending Spehrley application, the characteristics of hot melt inks used in ink jet systems are described and it is noted that the melting point of such an ink is the point at which the specific heat, i.e., the heat input required per unit mass of ink to cause a unit temperature change, passes through a peak and that the viscosity of the ink decreases rapidly between that point and the liquidus point of the ink, i.e., the point at which the ink is entirely in liquid form. In order to provide the desired decrease in contact angle and increase in radius of curvature of the ink drops in accordance with the present invention, the ink on the transparent substrate should be maintained above its melting point as thus defined, and preferably near or above the liquidus temperature, for a controlled period of time, for example, at least 0.5 seconds, so that surface tension and wetting forces can overcome viscous resistance to drop spreading.

While the size of the ink spot may continue to increase up to, for example, 6 to 8 mils diameter or more, and the contact angle may continue to decrease to values below 10° and even down to about 3°, with increased residence time at high temperature, the resolution of the image may be degraded since if the drops become too large, the image is not crisp. Such loss of resolution can be controlled in some cases by using smaller ink drops, but other considerations may preclude the use of smaller ink drops.

Moreover, as described hereinafter, for conventional projection lenses having an f/4 aperture, for example, it is not necessary to have a contact angle smaller than about 15° or a radius of curvature greater than about 10 mils in order to make certain that none of the rays passing through the spot are deviated by a large-enough angle to prevent their being received by the projection lens, and for larger aperture projection lenses, the contact angle may be as large as 25°, for example. These ink spot characteristics can normally be attained by maintaining the temperature of the ink above its melting point, preferably about 5° C. to 40° C. above its melting point and most preferably about 10° C. to 30° C. above its melting point, for about 1 to 10 sec. and, preferably, 1 to 5 sec.

In particular instances, maintaining drops of ink having a melting point of 54° C. on a transparent substrate at a temperature of 75° C. for 3.5 sec. reduced the contact angle of the drops from about 30° to below 15° and maintaining the same ink at a temperature of 95° C. for the same time reduced the contact angle to about 5°.

Maintaining the same ink at a temperature of 78° C. for 2.5 sec. reduced the contact angle to about 10°. Another ink which has a melting point of 55° C. was maintained at a temperature of 78° C. for 2.5 sec. to reduce the contact angle from about 35° to about 12°, and maintaining a temperature of 93° C. for the same time reduced the contact angle to about 8°.

For transmission viewing of hot melt ink images, such as from projected transparencies, it is further important to avoid extensive crystallization of the ink in the ink spots which will produce internal scattering and absorption of the light rays within the ink spot and frosting. In accordance with one aspect of the invention, such crystallization and frosting, which occurs more frequently in some inks than in other inks, can be inhibited or reduced to acceptable levels by quenching, i.e., cooling the ink through its melting point. The greatest clarifying effect may be obtained by quenching from about the liquidus temperature to below the melting temperature, although varying improvement has been obtained when inks have been heated to and quenched from a temperature between the melting and liquidus temperatures. To increase quenching rates, it may be useful to quench toward a temperature which is 20° C. to 50° C. below the melting temperature. For good business presentation image quality, the light transmission losses caused by crystallinity and frosting of the ink drops should be less than 50% and preferably less than 35%. Best results are obtained when such losses are reduced to levels below 20%. Quenching rates of at least 50° C. per second and preferably at least 100° C. per second have been found effective for this purpose and best results have been obtained with quenching rates of 500° C. per second to 1000° C. per second.

Moreover, while it is possible to maintain the ink drops jetted onto a substrate in molten condition at a selected temperature for the desired time immediately after the image is formed and then quench them as mentioned above, it is often preferable to print the ink image on a transparent substrate in the same manner as on an opaque substrate and subsequently reheat the image for the time required to permit drop spreading and then quench the ink drops by rapid cooling. In that case, the platen temperature used in the printing of the image is preferably maintained at a low enough level, such as 55° C. to 65° C., to inhibit drop spreading during the printing of the image and, after the image has been printed, the transparent sheet is reheated to a temperature of, for example, 10° C. to 30° C. above the melting point and maintained for 1 to 5 sec. to allow the necessary drop spreading and then cooled to a temperature of, for example, 50° C. in a fraction of a second. For this purpose, the transparent sheet containing the printed image is preferably passed through a separate remelt-/quench path having a heated platen maintained at a controlled temperature of, for example, 85° C. to 95° C. to remelt the ink image and providing a residence time long enough to maintain the ink in molten condition for about 3 sec., for example. Immediately thereafter, the transparency moves into contact with a quenching platen maintained, for example, at less than 40° C. With certain inks having a liquidus temperature in the range of 87° C. to 92° C., a melting point in the range of 55° C. to 75° C. and a solidus point in the range of 32° C. to 36° C., ink images having substantially reduced transmission losses resulting from crystallization and frosting have been produced by this procedure.

The substrate 20 may be made of any conventional transparent sheet material which is wetted by the ink in the ink spot 21. One such material is the transparency substrate marketed by the 3M Company with the designation 688, which has been found to provide completely satisfactory colored ink images.

The effect of the increase in radius of curvature and decrease in contact angle on transmission of light through the ink spot is illustrated by the paths of the light rays shown in the representative example illustrated in FIG. 2. In this illustration the surface 22 of the spot 21 has a diameter of 0.30 mils and a radius of curvature of about 8 mils and the angle of contact of the ink spot with the surface 25 of the transparent support 20 is 17°. The rays 15'–19' in FIG. 2 correspond to the entering rays 15–19, respectively, in FIG. 1, but, as shown in FIG. 2, they intersect the surface 22 at substantially smaller angles than in FIG. 1, resulting in correspondingly reduced deviations of the emerging rays.

In the example shown in FIG. 2, the rays 16' and 17' are incident on the surface 22 of the enlarged spot 21 at an angle of 7.8° and the rays 18' and 19' are incident at an angle of 9.5°. As a result, the emerging rays are deviated by angles of only about 3.5° and 4.3°, respectively, as shown in FIG. 2. Consequently, all of those rays are well within the 7.2 degree half angle subtended by an f/4 projection lens.

Moreover, the rays 27 and 28, which pass through the ink spot 21 at locations corresponding to the periphery of the ink spot 11 in FIG. 1, are incident on the surface 22 at an angle of 14.5°, resulting in a deviation of only about 6.8° from the direct line between the spot and the center of the projection lens. As noted above in connection with the rays 16 and 17 of FIG. 1, a deviation of 7.2° is produced by rays which are incident at an angle of 15.5° to the curved surface of the ink spot. Thus, all of the rays passing through an ink spot having a contact angle of 15.5° will be collected by a projection lens having an f/4 aperture.

It can be shown that, with a spot having the configuration of FIG. 2 and a contact angle of 17°, the contact angle of a ray with the surface 22 reaches 15.5° at a distance from the center of the spot which is about 94% of the radius of the spot so that approximately 87% of the light passing through the spot will be projected by a projection lens having an f/4 aperture. This is in contrast to the 19.4% transmission through the same projection lens from the ink spot 11 shown in FIG. 1. Moreover, no light would be lost from that spot using a projection lens having an aperture 50% larger, which would subtend a half angle of 10.7° as described with respect to the rays 18 and 19 in FIG. 1. Using that projection lens, light rays incident on the surface 22 at angles up to 21.7°, which would be deviated by 10.7° from paths parallel to the axis of the lens, would be collected by the lens. Thus, the larger aperture lens would collect all light from ink spots having an angle of contact with the substrate up to 21.7°.

Although the invention has been described herein with reference to specific embodiments, many modifications and variations of the invention will be obvious to those skilled in the art. For example, hot melt colored ink transparency images made by techniques other than ink jet printing, such as thermal transfer printing or the like, which may be subject to one or more of the shortcomings discussed above, may be improved by the use of the invention described herein. Accordingly, all such variations and modifications are included within the intended scope of the invention.

We claim:

1. A transparency comprising a transparent substrate and an ink pattern on the surface of the substrate containing a plurality of three-dimensional ink spots having curved surfaces, wherein the contact angle of the spots with the substrate is no more than about 25°.

2. A transparency according to claim 1 wherein the radius of curvature of the curved surfaces of the spots is no less than about 2.5 mils.

3. A transparency according to claim 1 wherein the radius of curvature of the curved surfaces on the spots is in the range from about 5 to 20 mils.

4. A transparency according to claim 1 wherein the contact angle is in the range from about 3° to about 20°.

5. A transparency according to claim 1 wherein the light transmission loss resulting from crystallinity and frosting in the ink spots in the pattern is no more than about 50%.

6. A transparency according to claim 5 wherein the light transmission loss resulting from crystallinity and frosting in the ink spots in the pattern is no more than about 35%.

7. A transparency according to claim 5 wherein the light transmission loss resulting from crystallinity and frosting in the ink spots in the pattern is no more than about 20%.

* * * * *

UNITED STATES PATENT AND TRADEMARK OFFICE

CERTIFICATE OF CORRECTION

PATENT NO. : 4,873,134

DATED : October 10, 1989

INVENTOR(S) : Steven J. Fulton et al.

It is certified that error appears in the above-identified patent and that said Letters Patent is hereby corrected as shown below:

Column 2, line 15: After the word "from" insert --the--; line 34: The word "obilquely" should read --obliquely--; line 35: The word "hence" should read --Hence--; line 61: The word "objection" should read --object--.

Column 3, line 50: The word "previosuly" should read --previously--.

Column 6, line 11: The letters "th" should read --the--; line 12: After the word "by" insert --a--.

Column 7, line 18: The word "about" should read --above--.

Column 8, line 12: The numbers "0.30" should read --5.30--.

Signed and Sealed this

Thirtieth Day of October, 1990

*Attest:*

HARRY F. MANBECK, JR.

*Attesting Officer*

*Commissioner of Patents and Trademarks*